United States Patent [19]

Baudin

[11] 4,129,081

[45] Dec. 12, 1978

[54] ROTARY INJECTOR FOR LIQUID RESIDUE INCINERATING FURNACE

[75] Inventor: Bernard Baudin, Paris, France

[73] Assignee: Etablissements P. Ferbeck & Vincent, Velizy-Villacoublay, France

[21] Appl. No.: 835,612

[22] Filed: Sep. 22, 1977

[30] Foreign Application Priority Data

Oct. 4, 1976 [FR] France ..... 76 29773

[51] Int. Cl.[2] ..... F23G 5/12

[52] U.S. Cl. ..... 10/238; 193/23; 239/587

[58] Field of Search ..... 110/238, 248, 313, 235; 193/23; 285/181, 184; 239/587

[56] References Cited

U.S. PATENT DOCUMENTS

| | | | |
|---|---|---|---|
| 1,800,920 | 4/1931 | Wilson et al. | 193/23 |
| 3,756,170 | 9/1973 | Lang | 110/238 |
| 3,780,674 | 12/1973 | Liu | 110/238 |
| 3,858,532 | 1/1975 | Jorgensen | 110/238 |
| 3,921,912 | 11/1975 | Hayes | 239/587 |
| 4,033,613 | 7/1977 | Bram | 285/184 |

FOREIGN PATENT DOCUMENTS

| | | | |
|---|---|---|---|
| 177825 | 1/1962 | Sweden | 110/238 |
| 465523 | 6/1975 | U.S.S.R. | 110/238 |

*Primary Examiner*—Henry C. Yuen

*Attorney, Agent, or Firm*—Cullen, Sloman, Cantor, Grauer, Scott, & Rutherford

[57] ABSTRACT

The invention relates to a vertical cylindrical furnace for the incineration of residual liquids, equipped with a rotary injector, said latter being more particularly constituted by a plurality of elements including an adjustable nozzle-holder. The adjustment of the angle of rotation of the nozzle-holder and the setting of the aperture of the nozzle make is possible, in one manoeuvre, to adjust the jet of liquid to be incinerated so that optimal use is made of the drying surface. Furthermore, the equipment of the furnace with a vault enables the drying surface to be increased with respect to a conventional cupola furnace. The invention finds particular application in furnaces for incinerating black liquor from paper mills.

5 Claims, 7 Drawing Figures

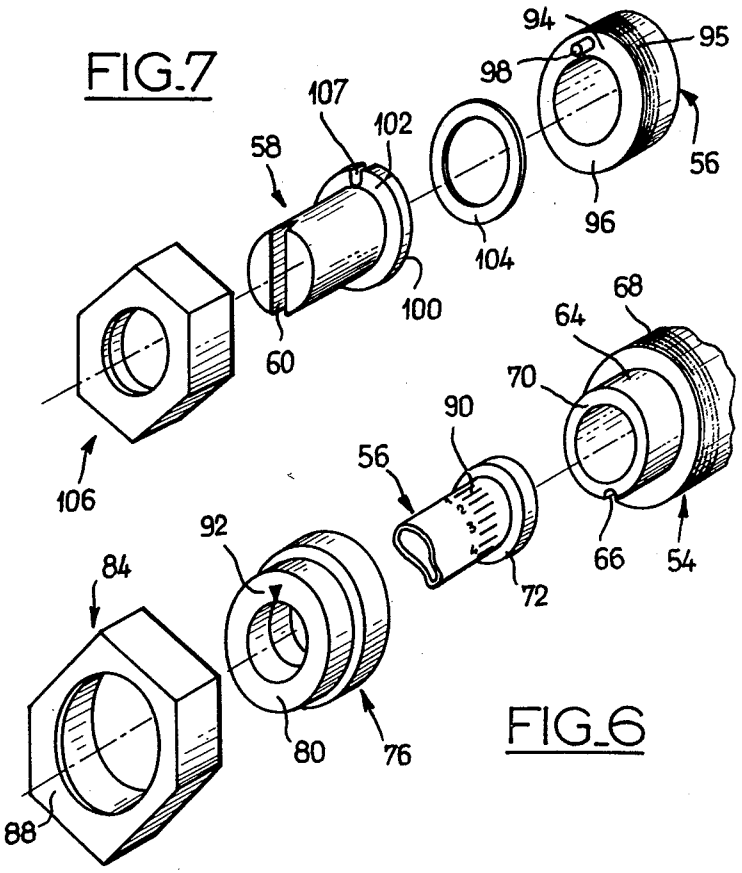
FIG.7
FIG.6
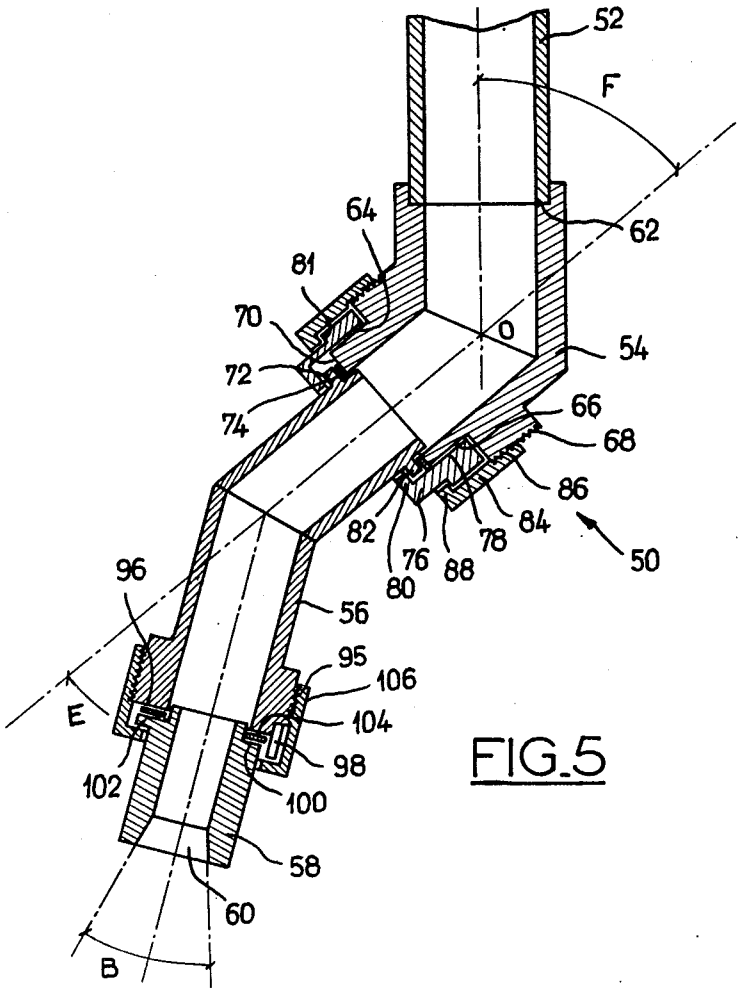
FIG.5

ROTARY INJECTOR FOR LIQUID RESIDUE INCINERATING FURNACE

The present invention relates to a furnace for the incineration of residual liquids and more particularly a rotary injector adapted to equip such a furnace.

Such furnaces serve to incinerate the residual liquids constituted by an organic matter dissolved in water, such as black liquor from paper mills.

The liquid to be destroyed is injected in the upper part of the furnace by means of a rotary injector mounted on an injection pipe; the flat jet produced strikes the wall, covering it with a layer of liquid. Under the action of the heat transmitted by the hot gases filling the furnace, the water evaporates, leaving a layer of combustible organic matter. When said latter has thickened after several passages of the rotary injector, the crust falls onto the bottom of the furnace where it is consumed under the action of air jets.

One drawback of such a rotary injector is that optimal drying is obtained only for one value of flow of residual liquid. In fact, the optimal drying conditions are obtained for a maximum drying surface determined by the revolution of an optimal segment of intersection of the flat jet and of the cylindrical wall.

The injector must therefore be regulated so that the droplets of liquid escaping from the upper part of the jet arrive on the wall just below the level of an opening for evacuation of the combustion gases and the droplets coming from the lower part of the jet must reach the lower limit, i.e. just above the layer of dried product.

Although this regulation is satisfactory for a given flow, the conditions of injection are not the same for a different flow. In fact, if the flow increases, the upper drops of the jet risk obstructing the gas-evacuation opening, whilst the lower droplets leave an unused drying surface free. If the flow reduces, the upper droplets, in turn, leave an unused drying surface, whilst the lower droplets risk extinguishing the furnace.

One solution has consisted in providing a set of removable injectors, mounted according to the desired flow of the liquid. This arrangement brings two other drawbacks: it is impossible to cover a given range of flows continuously; each change of injector involves loss of time and laborious manipulations.

Finally, the purchase and maintenance of a set of injectors are relatively expensive.

Furthermore, a conventional cupola adapted to obturate the top part of the furnace to support the injector is expensive and difficult to construct.

It is an object of the present invention to allow the use of a maximum drying surface on the cylindrical wall of a furnace of the above-mentioned type with one injector which is adapted to different flows. It relates in particular to a rotary injector comprising means for orientating the injection nozzle so that the liquid to be incinerated covers an optimal drying surface on the cylindrical wall for any flow in a given range of variation.

It is thus possible, with the aid of one device, to achieve the result which only a large set of rigid injectors enabled to be obtained beforehand.

In a preferred embodiment, said injector comprises an injection pipe, an intermediate elbow between said injection pipe and a nozzle-holder, said nozzle-holder and an injection nozzle, the nozzle-holder itself being bent and adapted to cooperate with the intermediate elbow with respect to which it is adjustable in rotation, so as to be able to give a determined orientation to the injection nozzle.

More precisely, it comprises a nozzle-holder adapted to cooperate with an intermediate elbow, a sliding ring adapted to apply the nozzle-holder on the elbow, in the extension one of the other, stopped in rotation with respect to the elbow, a shouldered nut adapted to stop the nozzle-holder in rotation with respect to the elbow, said nozzle-holder comprising graduations capable of moving in front of an index integral with the ring and enabling the position of the nozzle-holder to be adjusted as a function of the flow of liquid passing therethrough.

In another embodiment of the present invention, means may be provided for remotely controlling the orientation of the injection nozzle or servo-control means for automatically orientating the injection nozzle as a function of the flow of the liquid passing therethrough, so that the liquid to be incinerated covers an optimal drying surface on the cylindrical wall, whatever its flow.

In order to improve the drying qualities of the furnace, it may be provided to be equipped in its upper part with a vault supporting a rotary injector as described hereinabove, said vault enabling an opening to be made for evacuating the hot combustion gases above the upper limit of the cylindrical wall. A vault presents other advantages with respect to a conventional cupola. In fact, apart from a better use of the drying surface, it allows a simplified construction since it can be made with standard refractory bricks.

The invention will be more readily understood on reading the following description with reference to the accompanying drawings, in which:

FIG. 1 shows in axial section the diagram of a furnace of the type in question, equipped according to the present invention with a rotary injector for injecting residual liquid passing through a cylindrical vault.

FIG. 2 defines the angles characteristic of a rotary injector according to the prior art.

FIGS. 3 and 4 define the angles characteristic of a rotary injector according to the invention.

FIG. 5 shows an axial section through an injection assembly according to the invention.

FIG. 6 is a view, before assembly, of the elements effecting the connection of a nozzle-holder to an intermediate elbow in a rotary injector according to the invention.

FIG. 7 is a view similar to FIG. 6, showing a nozzle and its elements for connection to a nozzle-holder in a rotary injector according to the invention.

Figure 1:
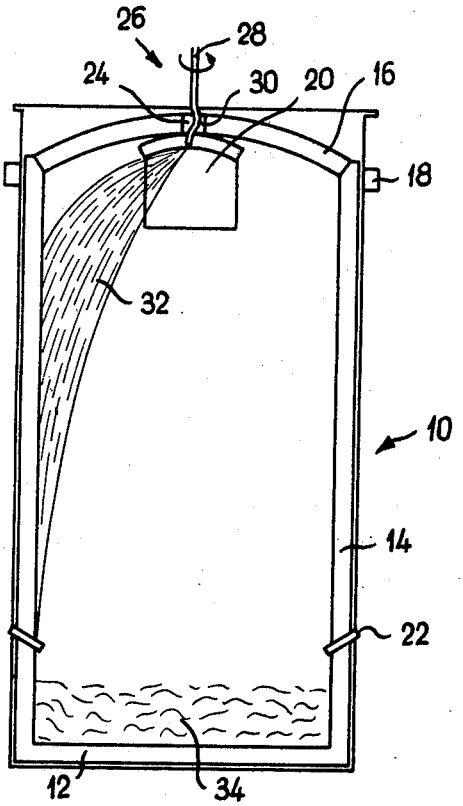

Referring now to the drawings, FIG. 1 shows a furnace 10 according to the invention intended for the incineration of residual liquids, which comprises a hearth 12 and a vertical cylindrical wall 14. Its upper part is limited by a vault 16. The horizontal components of the forces of the vault 16 on the wall 14 are taken up by an outer hooping 18.

An opening 20 is located in the axis of the vault for the evacuation of the hot gases. Vents 22 adapted to supply the furnace with air pass through the wall 14 in its lower part and an opening 24 allows passage of an injection assembly 26 comprising an injection pipe 28 and an injector 30.

A residual liquid is injected by the assembly 25 in a flat jet 32 spreading over the inner surface of the wall 14 in a cylindrical zone. The dried residues fall to the bottom of the furnace onto the hearth 12 where they form the fuel 34.

Figure 2:
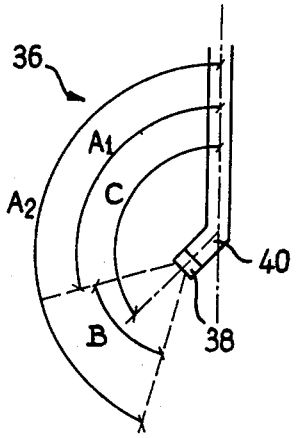

FIG. 2 is a vertical plan view.

The flat jet 32 issuing from an injector 36 according to the prior art is characterised by two angles denoted C and B. Angle B denotes the angle of spread of the jet on leaving the nozzle schematically shown at 38, supported by a nozzle-holder schematically shown at 40. Angle C designates the angle made by the axis of the nozzle-holder with the vertical. Angles $A_1$ and $A_2$ which are made, respectively by the upper edge and the lower edge of the jet with the vertical, determine the path of the droplets.

Figure 3:
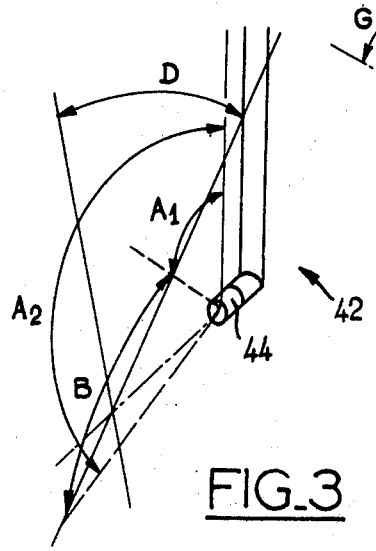

On the injector 42 shown in FIG. 3, a nozzle 44 is so orientated that the plane defined by the axis of the nozzle orientated along the largest width of the jet and called plane of spread of the jet and the axis of said nozzle makes an angle D with a vertical plane. If this angle D increases, concomitant variations of $A_1$ which increases and of $A_2$ which decreases, are observed. The apparent opening of the jet consequently reduces and it is as though the spread due to the nozzle modified fictitiously.

The purpose of the present invention is to adapt the angles B and C to the flow of the liquid to be incinerated. This problem may be replaced by the equivalent and more simple one of adapting the angles C and D to the flow of liquid.

Figure 4:
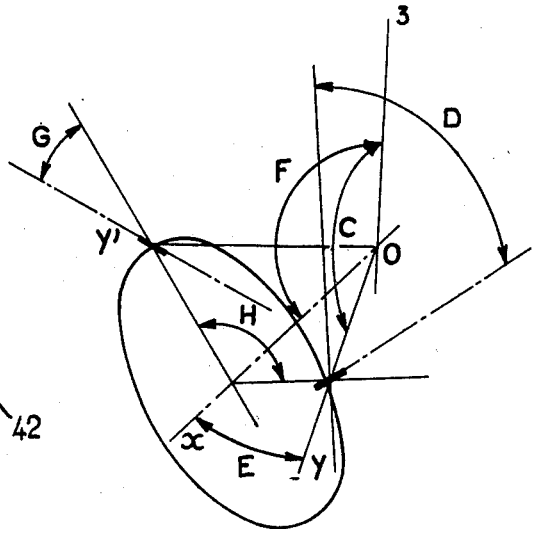

FIG. 4 shows the principle of a particularly simple and convenient embodiment of the present invention.

The nozzle may be mounted on a nozzle-holder movable about an axis. Ox, forming an angle E with the axis of the nozzle, Oy, and an angle F with the vertical Oz. In the reference position of the rotation of the nozzle-holder defined by a zero angle H, the angle D is noted G, denoting the initial orientation of the plane of spread of the jet.

Geometrically, the mathematical relationship between the values of angles C and D is known, using E, F and G as parameters.

Experimentally or theoretically, with the aid of the equations of conventional mechanics, 3 corresponding values of C and 3 values of D are determined, which are optimal for 3 given values of the flow, for example the extreme values and an intermediate value.

The value of B being imposed by the available nozzles, it is possible to determine the values of the 3 parameters E, F and G so as to dispose of 3 positions in rotation of the nozzle-holder about its axis, strictly adapted to 3 given flows.

Experience has shown that, apart from these 3 values, the difference between the value obtained and the value strictly necessary remains very small; adaptation is therefore sufficient in practice.

FIGS. 5, 6 and 7 relate to the embodiments of which the principle has been set forth hereinabove, and, like the following description, relate only to particular examples which in no wise limit the scope of the invention.

An injection assembly 50 comprises an injection pipe 52, an intermediate elbow 54, a nozzle-holder 56 and a nozzle 58. The various characteristic angles and parameters of the injector are made as follows:

The angle of the elbow 54 materialises the angle denoted F. The nozzle-holder 56, also bent, materialises the angle E. The ejection angle 60 of the nozzles 58 makes angle B.

The elbow 54 is for example fast by its ends with the injection pipe 52 on the one hand, and the nozzle-holder 56 on the other hand. This latter may then be fast with the nozzle 58. The connection between the pipe and the intermediate elbow is rigid as well as between the nozzle-holder and the nozzle. The connection between the intermediate elbow and the nozzle-holder may, as desired, be rigid or free to rotate about axis Ox. The rotation of the nozzle-holder 56 with respect to the intermediate elbow 54 determines angle H.

Finally, angle G, which is not variable, may be due to the particular assembly of the nozzle 58 on the nozzle-holder 54.

The injection pipe 52 (shown only partially) may be in the form of a cylindrical pipe whose end section is adjusted on a shoulder 62 of the intermediate elbow 54.

At its other end, the intermediate elbow 54 comprises an outer shoulder 64 provided with an axial channel 66 on the small diameter and a thread 68 on the nominal diameter. The end face 70 of the elbow 54 is for example adapted to cooperate with a flange 72 of the nozzle-holder 56 with the interposition of an O-ring 74.

Inter alia, a sliding ring 76 may slide on the shoulder 64 and comprise a guide pin 78 engaged in the groove 66. The ring 76 is consequently stopped in rotation with respect to the elbow 54. It may, furthermore, comprise an annular raised edge 80 adapted to cooperate with the face 82 not in contact with the O-ring 74 of the flange 72. Finally, it is provided with an outer shoulder 81. The ring 76 is then stopped in axial translation by a shouldered nut 68 whose tapping 86 is adapted to cooperate with the thread 68, of which the shoulder 88 is applied on shoulder 81.

In this precise embodiment, the nozzle-holder 56 stopped in axial translation by the face 70 of the intermediate elbow 54 on the one hand and by the face 82 of the ring 76 on the other hand, is free to rotate with respect to the elbow 54 on condition that the shouldered nut 84 is not tightened. By successive adherences of the nut 84 on the ring 76 and on the flange 72, the nozzle-holder 56 is blocked in the case of tightening of the nut 84 with respect to the elbow 54.

The different values of the angle H and consequently the corresponding values of the ideal flow may be marked with the aid of a graduation 90 carried by the nozzle-holder 56 adapted to move in front of an index 92 borne by the ring 76.

In the same example, at its end opposite the flange 72, the nozzle-holder 56 may comprise a further flange 94. A thread 95 is then made on the outer shoulder. On the end face 96 of the flange 94 a pin 98 is force fitted. In an assembly which may be similar to that of the nozzle-holder on the intermediate elbow, the nozzle 58 may cooperate with the nozzle-holder 56 by a face 100 of a flange 102 applied against the face 96 by the interposition of a seal 104. An axial groove 106 made in the flange 102 then enables the pin 98 to position the nozzle with respect to the nozzle-holder with a given angle G. A shouldered nut 106 cooperates with a face of the flange 102 by its shoulder and the thread 95 by its tapping to connect the nozzle with the nozzle-holder.

The nozzle 58 is characterised by its aperture 60 adapted to form the flat jet 32 of angle of spread B.

A rotary injector of the type described is intended to operate with constant flow for a long time. It is necessary to dismantle the injector at regular intervals to check the state thereof. Adjustment may therefore be made manually for changing flow.

In another embodiment (not shown), the adjustment of the injector, i.e. the rotation of the nozzle-holder 56 about axis Ox, may be effected by semi-automatic means enabling for example remote control due to a servo-control motor, or by an automatic means requiring a servo-control circuit known per se.

Any mechanical, pneumatic, hydraulic, electrical control of a rotary injector obviously comes within the scope of the present invention, as well as any other embodiment of the rotary injector described hereinabove.

What is claimed is:

1. In a vertical cylindrical furnace for incinerating liquid residues, a rotary injector for injecting the residues to be dried on the wall of said furnace, comprising, an injection pipe and an injection nozzle, a nozzle-holder and an intermediate elbow between the injection pipe and said nozzle-holder, the nozzle-holder itself being bent and adapted to cooperate with the intermediate elbow with respect to which it is adjustable in rotation, so as to be able to give a determined orientation to the injection nozzle, so that the liquid to be incinerated covers an optimal drying surface on the cylindrical wall for any flow within a given range of variation; a sliding ring adapted to apply the nozzle-holder on the elbow in the extension one of the other, stopped in rotation with respect to the elbow, a shouldered nut adapted to stop the nozzle-holder in rotation with respect to the elbow.

2. The furnace of claim 1, said rotary injector including means for remotely controlling the orientation of the injection nozzle.

3. The furnace of claim 1, said rotary injector including servo-control means for automatically orienting the injection nozzle as a function of the flow of the liquid passing therethrough, so that the liquid to be incinerated covers an optimal drying surface on the cylindrical wall, whatever its flow.

4. The furnace of claim 1, said nozzle-holder bearing graduations adapted to move in front of an index integral with the ring and enabling the position of the nozzle-holder to be adjusted as a function of the flow of liquid passing therethrough.

5. The furnace of claim 1, wherein it is equipped in its upper part with a vault supporting the rotary injector, said vault enabling an opening to be arranged for the evacuation of the hot combustion gases above the upper limit of the cylindrical wall.

* * * * *